US006931889B1

(12) United States Patent
Foglietta et al.

(10) Patent No.: US 6,931,889 B1
(45) Date of Patent: Aug. 23, 2005

(54) CRYOGENIC PROCESS FOR INCREASED RECOVERY OF HYDROGEN

(75) Inventors: Jorge H. Foglietta, Missouri City, TX (US); Paul Milios, Katy, TX (US); Fereidoun Yamin, Houston, TX (US)

(73) Assignee: ABB Lummus Global, Randall Gas Technologies, Houston, TX (US)

( * ) Notice: Subject to any disclaimer, the term of this patent is extended or adjusted under 35 U.S.C. 154(b) by 0 days.

(21) Appl. No.: 10/419,579

(22) Filed: Apr. 21, 2003

Related U.S. Application Data

(60) Provisional application No. 60/374,048, filed on Apr. 19, 2002.

(51) Int. Cl.[7] ..... F25J 3/00
(52) U.S. Cl. ..... 62/619; 62/618; 62/622
(58) Field of Search ..... 62/618, 619, 620, 62/622

(56) References Cited

U.S. PATENT DOCUMENTS

| | | | | | |
|---|---|---|---|---|---|
| 2,494,120 | A | | 1/1950 | Ferro, Jr. | |
| 2,617,272 | A | | 11/1952 | Aicher | |
| 3,508,413 | A | * | 4/1970 | Pryor | 62/622 |
| 3,625,017 | A | * | 12/1971 | Hoffman | 62/622 |
| 3,628,340 | A | | 12/1971 | Meisler et al. | |
| 3,675,435 | A | * | 7/1972 | Jackson et al. | 62/622 |
| 4,002,042 | A | | 1/1977 | Pryor et al. | |
| 4,185,977 | A | | 1/1980 | Shirokov et al. | |
| 4,608,068 | A | * | 8/1986 | Bauer et al. | 62/623 |
| 4,617,039 | A | * | 10/1986 | Buck | 62/621 |
| 4,619,679 | A | | 10/1986 | DeLong | |
| 4,629,484 | A | | 12/1986 | Kister | |
| 4,749,393 | A | | 6/1988 | Rowles et al. | |
| 4,756,730 | A | | 7/1988 | Stupin | |
| 4,854,955 | A | * | 8/1989 | Campbell et al. | 62/621 |
| 5,275,005 | A | * | 1/1994 | Campbell et al. | 62/621 |
| 5,414,168 | A | | 5/1995 | Scott | |
| 5,505,048 | A | | 4/1996 | Ha et al. | |
| 5,799,507 | A | * | 9/1998 | Wilkinson et al. | 62/621 |
| 6,048,508 | A | | 4/2000 | Dummersdorf et al. | |
| 6,105,390 | A | | 8/2000 | Bingham et al. | |
| 6,425,263 | B1 | | 7/2002 | Bingham et al. | |
| 6,442,969 | B1 | | 9/2002 | Rojey et al. | |
| 6,712,880 | B2 | * | 3/2004 | Foglietta et al. | 95/184 |
| 2003/0029190 | A1 | * | 2/2003 | Trebble | 62/620 |

* cited by examiner

*Primary Examiner*—William C. Doerler
(74) *Attorney, Agent, or Firm*—Bracewell & Giuliani LLP

(57) ABSTRACT

A cryogenic process and apparatus to recover hydrogen from a fuel gas stream. The process can be stand alone or can be combined with existing processes, such as recovery of LPG from a fuel gas stream. In the stand-alone process, the fuel gas is cooled in one or more stages and sent to a cold separator that is used to separate the feed into a liquid and vapor stream. The liquid stream, is then warmed, compressed and then cooled and sent for further processing. The vapor stream, which contains hydrogen, is compressed, cooled when needed, and then returned for use in the existing facility or exported. The stand-alone process can be integrated within an LPG recovery process. The result of this cryogenic process is recovery of hydrogen from a fuel gas stream with only a slight decrease in hydrogen purity.

26 Claims, 4 Drawing Sheets

CRYOGENIC PROCESS FOR INCREASED RECOVERY OF HYDROGEN

RELATED APPLICATIONS

This patent application claims priority to U.S. Provisional Patent Application Ser. No. 60/374,048 filed on Apr. 19, 2002, which is incorporated by reference.

BACKGROUND OF THE INVENTION

1. Technical Field of the Invention

The present invention relates to the recovery of hydrogen ($H_2$) from refinery, petrochemical and chemical gas streams. More particularly, some of these streams are sent to a common fuel gas header. Recovery of the $H_2$ present in these streams produces savings in the operating costs. This invention relates to a method to cryogenically recover hydrogen and hydrogen with liquefied petroleum gas (LPG) from a fuel gas stream.

2. Description of the Prior Art

Hydrogen is an important consumable in hydrocarbon processing to refine oil products and petrochemicals. Hydrogen is also used for refining other chemicals and for food processing. Most hydrogenation and hydrotreating processes require hydrogen at relatively high purity. Some hydrocarbon processes export relatively low purity hydrogen that is usually recovered and recycled for use in processes without high hydrogen purity requirements. The recovery of hydrogen at very high purity is done with the use of adsorption processes, such as pressure swing adsorption, which delivers a hydrogen purity of 99.99% hydrogen. Adsorption technologies are usually associated with relatively large pieces of process equipment, such as pressure vessels, and typically contain proprietary adsorbents, such as zeolites. Both of these characteristics associated with this type of technology result in high capital and operating costs.

In some processes however, it would be more economical to achieve a higher yield of hydrogen at a lower purity. Cryogenically recovering hydrogen from fuel gas streams, as described in greater detail below, achieves a recovery level in the range of about 99.5% with a hydrogen purity of around 95%. Cryogenic hydrogen recovery within an LPG recovery process would be desirable to increase the desirable products to be recovered from a fuel gas stream and reduce operating and capital costs since the process units are combined.

Others have attempted to recover hydrogen from various types of hydrocarbon streams in the past. An example process can be found in U.S. Pat. No. 4,756,730 issued to Stupin. In Stupin, two or more industrial by-product hydrogen gas streams are first segregated by type to produce two feed streams for the process. One of the feed streams combines all of the by-product hydrogen gas streams containing detrimental amounts of non-readily condensable impurities having boiling points below that of methane, e.g., nitrogen, helium, and the like. The other feed stream combines all of the by-product hydrogen gas streams that are substantially free of non-readily condensable impurities. The two feed streams are then separately passed through successive cooling and separation stages. At each separation stage, a liquid bottom fraction containing readily condensable hydrocarbons is separated from the remaining overhead gas of each of the two feed streams. Successive separations are carried out until the overhead streams, which are substantially free of non-readily condensable impurities, achieve the desired degree of purity. When this occurs, the bottom fraction of this stream is primarily liquid methane and is used to scrub a majority of nitrogen and like impurities from the overhead of the streams containing significant amounts of these non-readily condensable impurities. The process in Stupin requires additional process equipment to perform each of the separation steps with recovered hydrogen purity of about 90%. The capital costs associated with installing the needed equipment for this process can be relatively high.

In addition to processes for recovering hydrogen, processes for purifying hydrogen have also been developed. An example process for cryogenically purifying hydrogen is described in U.S. Pat. No. 3,628,340 issued to Meisler et al. In Meisler, the feed gas stream typically contains between 45 and 65 percent hydrogen at a pressure of between 400 and 900 psia. Meisler separates condensable contaminants, such as methane, from a crude hydrogen stream by utilizing a series of multipass heat exchangers through which the gas flows for stepwise cooling, with interstage separation of condensates that are expanded and passed in a reverse flow path for autogenous refrigeration. Supplemental refrigeration can be provided for the last cooling stage to maintain the plant in proper heat balance for variations in feed gas composition and to facilitate startup. Meisler's process is useful for only limited feed gas specifications and requires substantial process equipment to perform the described series of separations and to keep each separate expanded condensate of the respective fractions in its own effluent vapor line. This leads to high capital costs, maintenance issues, and large space requirements.

Others have developed processes for recovering refrigeration, liquefaction, and separation of various products besides hydrogen. An example of such a process can be found in U.S. Pat. Nos. 6,105,390 and 6,425,263 issued to Bingham et al. (collectively "Bingham"). The process of the Bingham Patent is directed to a process for recovering refrigeration, liquefaction, and separation of gases with varying levels of purity. In the Bingham Patent, the feed stream is cooled and then separated into a vapor and a liquid stream. The liquid stream is then sent to an expander where the liquid stream is cooled and sent to the inlet cooler, thereby providing refrigeration to cool the inlet gas. The cycle is then repeated until all of the component gases are separated from the desired gas stream. The final gas stream is then passed through a final heat exchanger and expander. The expander decreases the pressure on the gas stream, thereby cooling the stream and causing a portion of the gas stream to liquefy within a tank. The portion of the gas that does not liquefy is sent back through each of the heat exchangers as a refrigerant. As in the Stupin Patent, the process in Bingham requires additional process equipment to enable the stream to be separated enough times to achieve the desired purity of the stream.

A need exists for a more economical and efficient method of increasing the amount of hydrogen that is recovered from a fuel gas stream. It would be desirable to add the hydrogen recovery process to an existing process, such as a hydrogenation plant that uses hydrogen. A process apparatus to increase the amount of hydrogen recovered from a fuel gas stream without having to add extra equipment, which increases capital and operating costs associated with the process, would be advantageous. Additionally, it would be advantageous to add the hydrogen recovery process to an existing process, such as hydrogenation processes.

SUMMARY OF THE INVENTION

The present invention includes a process and apparatus to recover hydrogen from a fuel gas stream. The invention can be used as a stand-alone process or can be combined with existing processes, such as recovery of LPG from a fuel gas stream, as well. In the stand-alone process embodiment, the fuel gas is cooled and sent to a cold separator that is used to separate the feed into a liquid and vapor stream. The fuel gas stream can be cooled in more than one stage. The liquid stream, is then warmed, compressed and then cooled and sent to a refinery for processing. The vapor stream, which contains hydrogen, is compressed, cooled when needed, and then returned for use in the existing facility or exported. The result of this cryogenic process is recovery of hydrogen from a fuel gas stream with only a slight decrease in hydrogen purity of 95% compared to 99.99%.

When hydrogen is recovered along with LPG, two different tower schemes can be used. In one embodiment, a first tower feed stream is sent to the top of the tower as a feed/reflux stream. Feeding the first tower feed stream at the top of the tower eliminates the need for an overhead condenser and reflux stream, making the tower a reboiled absorber. In an alternate embodiment, a fractionation tower can be used with a conventional condenser that refluxes a portion of the condensed fractionation overhead stream back to the fractionation tower.

Along with the processes for recovery of hydrogen, the apparatus required to perform the hydrogen processes is also advantageously provided. In the processes for recovering hydrogen along with LPG, a reboiled absorber can be provided if the first tower feed stream is sent to a first theoretical stage of the reboiled absorber. If the first tower feed stream is not sent to the first theoretical stage, a conventional fractionation tower can be provided. If a fractionation tower is used, a condenser that refluxes a portion of the condensed fractionation overhead stream back to the fractionation tower will also be provided.

BRIEF DESCRIPTION OF THE DRAWINGS

So that the manner in which the features, advantages and objects of the invention, as well as others that will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE DRAWINGS

For simplification of the drawings, figure numbers may be the same in FIGS. 1 through 4 for various streams and equipment when the functions are the same, with respect to the streams or equipment, in each of the figures.

Figure 1:
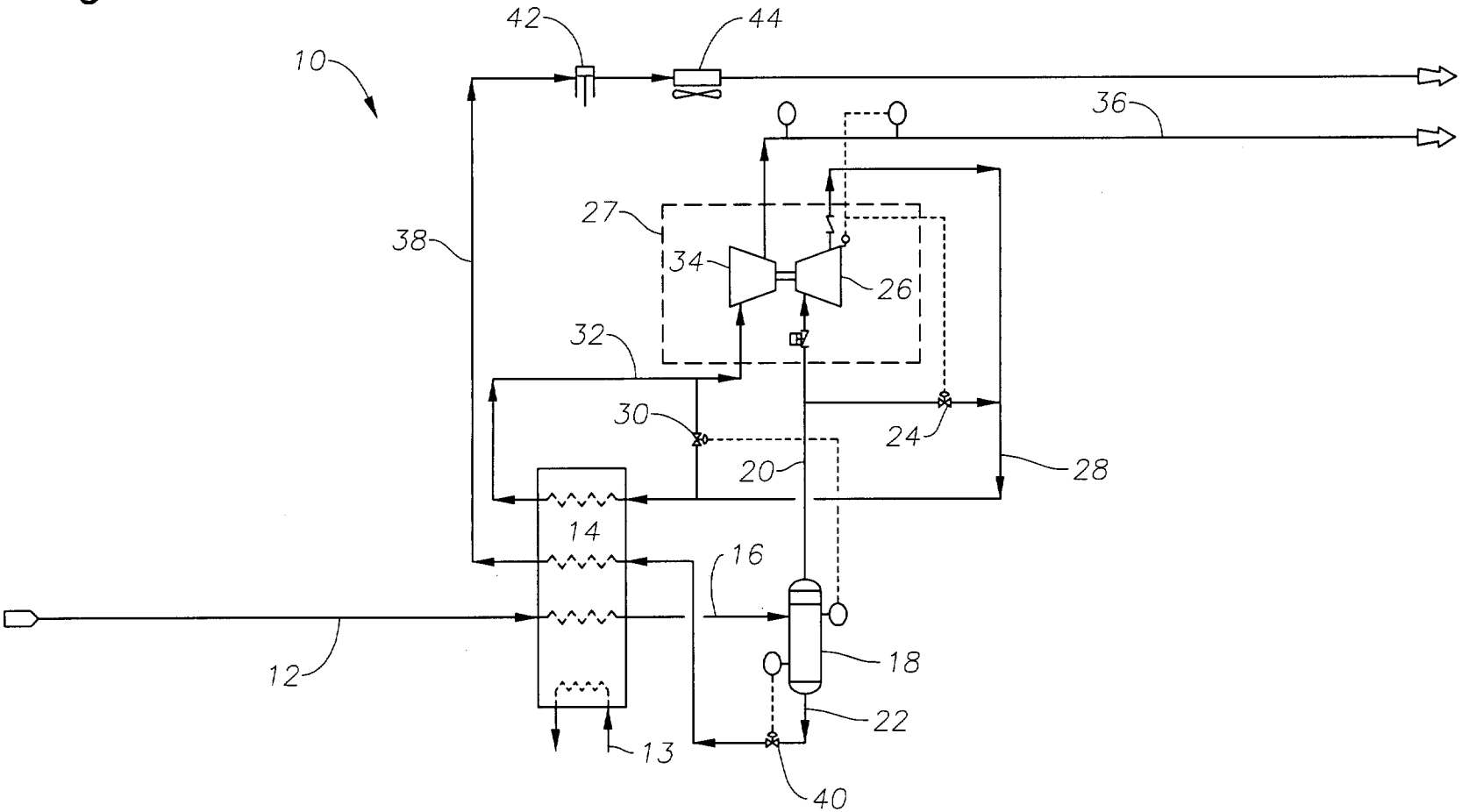
FIG. 1 is a simplified flow diagram of a hydrogen recovery process that incorporates the improvements of the present invention and is configured for increased recovery of hydrogen from a fuel gas stream.

FIG. 1 illustrates one embodiment of the hydrogen recovery scheme 10. A feed gas stream 12 is first sent through dehydration and inlet processing (not shown). Feed gas stream 12 is then cooled by heat exchange contact with one or more process streams in a front-end exchanger 14 to produce a cooled feed gas stream 16. The process streams used to cool feed gas stream 12 can include a first liquid stream 22, an expanded stream 28, an external refrigerant stream 13, and combinations thereof. In all embodiments of this invention, front-end exchanger 14 can be a single multi-path exchanger, a plurality of individual heat exchangers, or combinations thereof. Cooled feed gas stream 16 then goes to one or more cold separator(s) 18 or absorbers where first vapor stream 20 and first liquid stream 22 are produced as a result of separating the cooled feed stream 16.

First vapor stream 20 is sent to an expander 26 to decrease the pressure of first vapor stream 20 and emerge as expanded stream 28. During the expansion, the temperature of first vapor stream 20 is lowered and work is produced. This work is later recovered in a booster compressor 34 driven by the expander 26 to partially regain pressure, while the low temperature of expanded stream 28 is used to at least partially refrigerate the process. Expander 26 can be any type of rotating expander resulting in expansion known by one skilled in the art. For example, the expander can be a centrifugal turboexpander. If desirable, expander 26 can be an expander train 27 with more than one expander in all embodiments of the present invention. Expanded stream 28 is sent to front end exchanger 14 to provide cooling to the feed gas stream 12 and emerges as warmed vapor stream 32. Expanded stream 28 can be temperature controlled by temperature control valve 30 to bypass front-end exchanger 14, if feed gas stream 12 needs to be cooled further. Warmed vapor stream 32 is then compressed in booster-compressor 34 and emerges as the recovered hydrogen product stream 36. Booster-compressor 34 can be any type of device resulting in compression known by one skilled in the art. For example, the booster-compressor can be driven by expander 26. Recovered hydrogen product stream 36 can then be supplied to a refinery or the like for further processing. With this new process, the typical yield of hydrogen recovery is around 99.5% with a purity of around 95%.

First liquid stream 22 is heated in front end exchanger 14, wherein at least a portion of first liquid stream 22 is vaporized, producing a second vapor stream 38. First liquid stream 22 can be level controlled by level control valve 40 based upon a liquid level in separator 18. Second vapor stream 38 is sent to a compressor 42 and compressor cooler 44 in order for second vapor stream 38 to meet pipeline sales gas specifications. Second vapor stream 38 contains a fuel gas stream substantially free of hydrogen, which is sent to a refinery for further processing.

Figure 2:
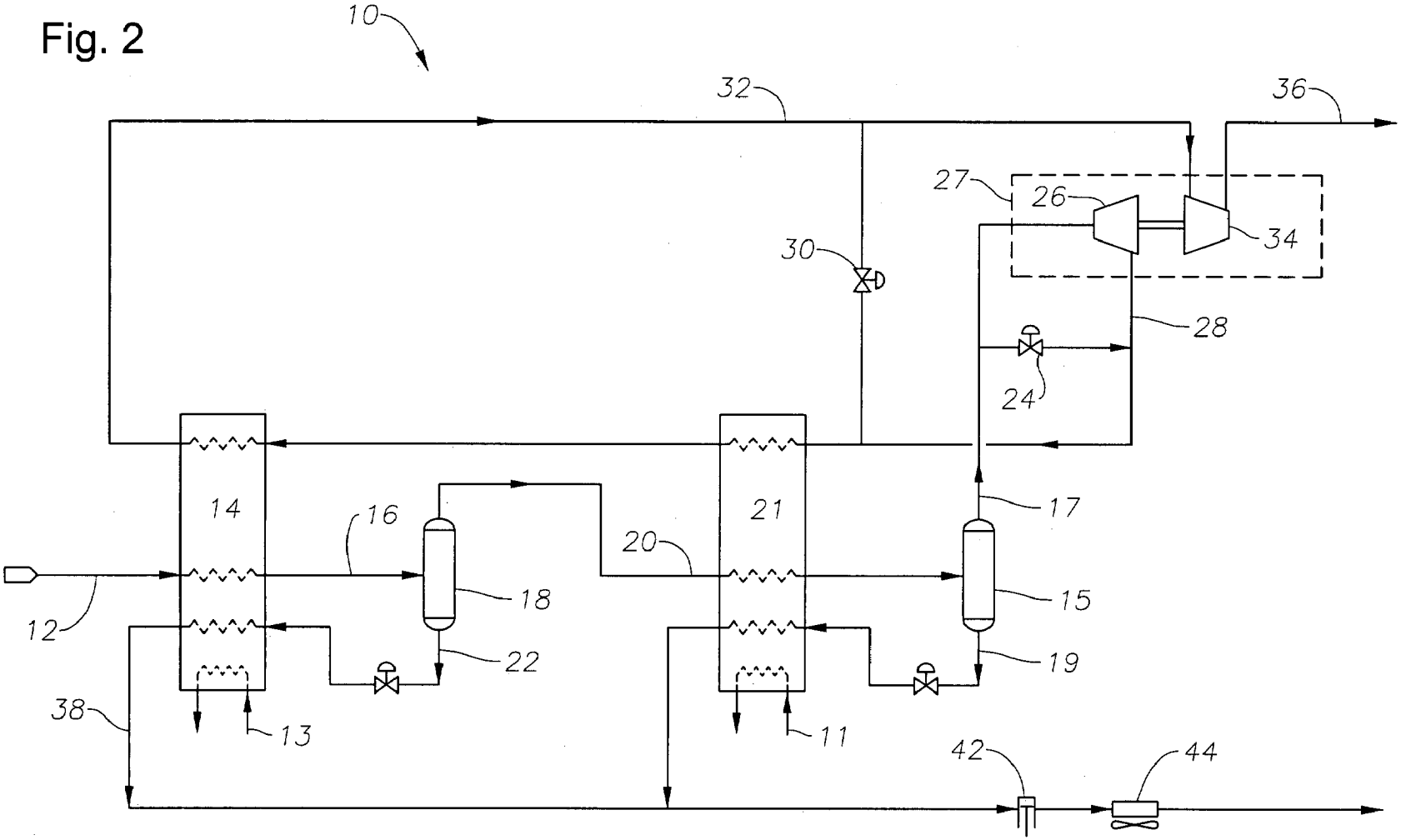
FIG. 2 is a simplified flow diagram of an hydrogen recovery process utilizing two stages for cooling an inlet feed gas in accordance with an embodiment of the present invention.

FIG. 2 illustrates an alternate embodiment of the process illustrated in FIG. 1. In particular, cooling of the feed gas stream 12 occurs in two stages, 3. In this embodiment, a process for recovering hydrogen from a fuel gas stream by means of a cryogenic process is advantageously provided.

Feed gas stream 12 is supplied, cooled, and at least partially condensed in front-end exchanger 14 by heat exchange contact with one or more process streams. The process streams used to cool feed gas stream 12 can include a first liquid stream 22, an expanded stream 28, an external refrigerant stream 13, and combinations thereof. Feed gas stream 12 is separated into a first vapor stream 20 and first liquid stream 22. First vapor stream 20 is cooled in second heat exchanger 21, at least partially condensed, and separated into a second vapor stream 17 and a second liquid stream 19. First vapor stream 20 is cooled by heat exchange contact with one or more process streams. The process streams used to cool first vapor stream 20 can include second liquid stream 19, expanded stream 28, an external refrigerant stream 11, and combinations thereof. Second vapor stream 17 is expanded, which decreases a pressure of second vapor stream 17 thereby producing expanded stream 28. Expanded stream 28 is heated to produce a warmed vapor stream 32 that is compressed by compressor 34 to produce a product hydrogen stream 36.

First liquid stream 22 and second liquid stream 19 are heated and at least partially vaporized to produce a third vapor stream 38. Third vapor stream 38 is compressed in compressor 42 and cooled by cooler 44 to produce a fuel gas stream substantially free of hydrogen.

Figure 3:
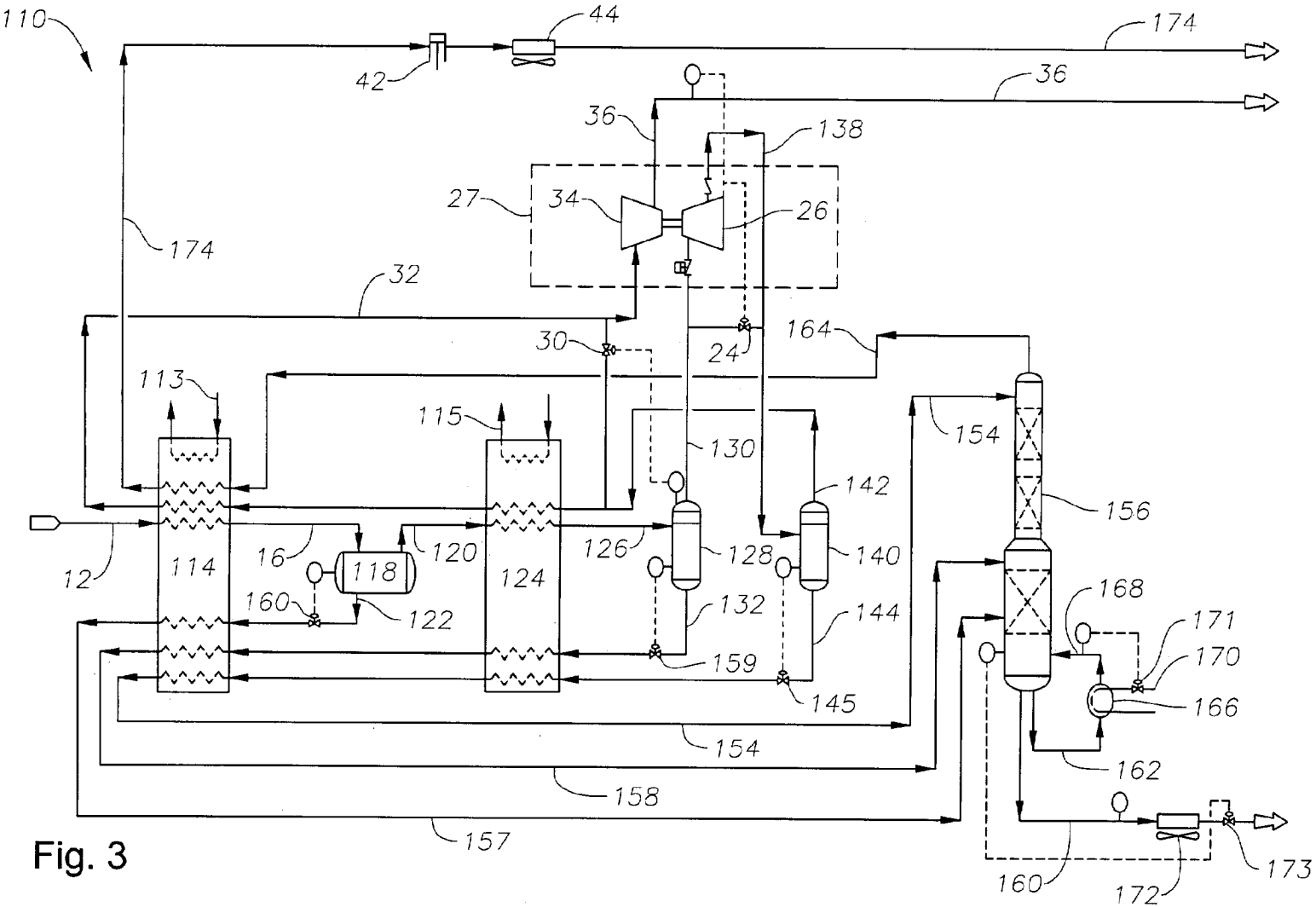
FIG. 3 is a simplified flow diagram of an hydrogen and LPG recovery process that incorporates the improvements of the present invention and is configured for recovery of hydrogen from a fuel gas stream in addition to recovery of LPG utilizing a reboiled absorber tower.

FIG. 3 illustrates an alternate embodiment of the present invention wherein the improved hydrogen recovery process is integrated within an LPG recovery process 110 utilizing a reboiled absorber as a tower. In this embodiment, feed gas stream 12 is first sent through dehydration and inlet processing (not shown). Feed gas stream 12 is then cooled and at least partially condensed by heat exchange contact with one or more process streams in a first exchanger 114. The process streams used to cool feed gas stream 12 can include a first liquid stream 122, a second liquid stream 132, a third liquid stream 144, a third vapor stream 142, a tower vapor stream 164, a supplemental or external refrigerant stream 113, and combinations thereof. In all embodiments of this invention, each exchanger can be a single multi-path exchanger, a plurality of individual heat exchangers, or combinations thereof. The external refrigerant stream 113, such as propylene, can be supplied to first exchanger 114, if needed for additional cooling. The cooled feed gas stream 16 then goes to one or more high-pressure separator(s) 118 or absorbers where a first vapor stream 120 and first liquid stream 122 are produced as a result of separating the cooled feed gas stream 16. First liquid stream 122 is sent to first exchanger 114. First liquid stream 122 can be level controlled by a first level controller 160 based upon a liquid level in high pressure separator 118 that contains first liquid stream 122.

First vapor stream 120 is cooled in second exchanger 124 by heat exchange contact with one or more process streams and emerges as cooled vapor stream 126. The process streams used to cool first vapor stream 120 can include second liquid stream 132, third liquid stream 144, third vapor stream 142, an external refrigerant stream 115, and combinations thereof. Cooled vapor stream 126 is sent to one or more suction separator(s) 128 or absorbers where a second vapor stream 130 and second liquid stream 132 are produced as a result of separating cooled vapor stream 126. Second vapor stream 130 is sent to an expander 26 to decrease the pressure of second vapor stream 130 and emerge as expanded stream 138. During the expansion, the temperature of second vapor stream 130 is lowered and work is produced. This work is later recovered in booster compressor 34 driven by expander 26 to partially regain pressure, while the low temperature of expanded stream 138 is used to at least partially refrigerate the process. Expander 26 can be any type of device resulting in expansion known by one skilled in the art. A series of expanders, or expander train, 27 can be used, if needed, to achieve the required pressure decrease. Expanded stream 138 is sent to one or more hydrogen separator(s) 140 or absorbers where third vapor stream 142 and third liquid stream 144 are produced as a result of separating expanded stream 138. Third vapor stream 142 can be temperature controlled by temperature control valve 146 to bypass second exchanger 124 and first exchanger 114 when feed gas stream 12 needs to be cooled further, as indicated by temperature indicator. Third vapor stream 142 is sent to second exchanger 124 and front end exchanger 14 to provide cooling to the feed gas stream 12 and emerges as warmed vapor stream 32. Warmed vapor stream 32 is then compressed in a booster-compressor 34 and emerges as the recovered hydrogen product stream 36. Booster-compressor 34 can be any type of device resulting in compression known by one skilled in the art. Recovered hydrogen product stream 36 can then be supplied to a refinery for further processing.

Third liquid stream 144 is heated in second exchanger 124 and front end exchanger 14, wherein at least a portion of third liquid stream 144 is vaporized, producing a first tower feed stream 154. Third liquid stream 144 can be level controlled by third level controller 145 based upon the liquid level in hydrogen separator 140. First tower feed stream 154 is sent to a reboiled absorber 156 at a first theoretical stage within reboiled absorber 156. Reboiled absorber 156 can be any type of device that transfers materials from a liquid phase into a vapor phase having a reboiler, but no condenser, and will be known to those skilled in the art. First tower feed stream 154 acts as a feed stream and as a reflux stream for reboiled absorber 156.

Second liquid stream 132 is heated in second exchanger 124 and front end exchanger 14, wherein at least a portion of second liquid stream 132 is vaporized, producing a second feed stream 158. Second liquid stream 132 can be level controlled by second level controller 159 based upon the liquid level in suction separator 128. First liquid stream 122 is heated in front end exchanger 14, wherein at least a portion of first liquid stream 122 is vaporized. First liquid stream 122 can be level controlled by first level controller 160, which is based upon the liquid level in high-pressure separator 118, as previously discussed. The heated first liquid stream 122 is sent to reboiled absorber 156 as a third tower feed stream 157.

In reboiled absorber 156, first tower feed stream 154, second tower feed stream 158, and third tower feed stream 157 are supplied to one or more mid-tower feed trays to produce a tower bottoms stream 160 and tower vapor stream 164. Second tower feed stream 158 is typically fed at a lower feed tray than first tower feed stream 154. Third tower feed stream 157 is typically fed at a lower feed tray than second tower feed stream 158. The tower feed streams 154, 158, and 157 can be sent to reboiled absorber 156 independently. Alternatively, one or more of the tower feed streams 154, 158, and 157 can be combined and fed to reboiled absorber 156 together.

Reboiled absorber 156 separates first, second, and third tower feed streams 154, 158, and 157 to produce a tower bottoms stream 160 and a tower vapor stream 164. Bottoms stream 160 exits reboiled absorber 156 preferably through the bottom of reboiled absorber 156. Bottoms stream 160 is cooled in bottoms exchanger 172 to produce an LPG product stream that contains substantially at least 70% of propane ($C_3$) and heavier compounds. Bottoms stream 160 can be level controlled by fourth level controller 173 based upon a liquid level in reboiled absorber 156.

Tower vapor stream 164 is warmed in front end exchanger 114 by heat exchange contact with one or more process streams. The process streams can include third vapor stream 142, feed gas stream 12, first liquid stream 122, second liquid stream 132, third liquid stream 144, an external refrigerant stream 113, and combinations thereof. Tower vapor stream 164 emerges as a fuel gas vapor stream 174. Fuel gas vapor stream 174 is sent to a compressor 42 and compressor cooler 44 in order for fuel gas vapor stream 174 to meet fuel gas specifications. Fuel gas vapor stream 174 contains a fuel gas stream substantially free of hydrogen, which is sent, preferably to a refinery, for further processing.

Figure 4:
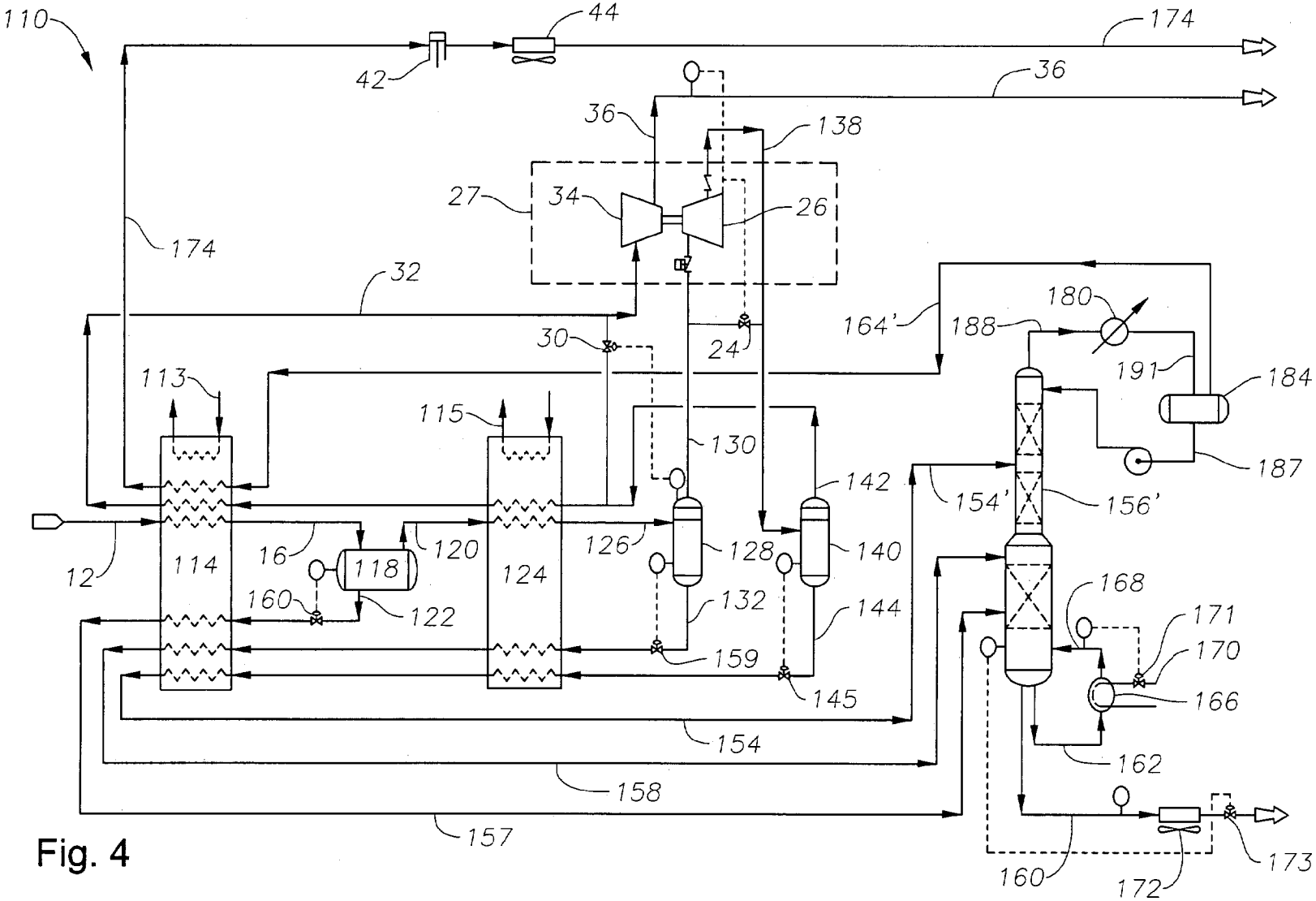
FIG. 4 is a simplified flow diagram of an hydrogen and LPG recovery process that incorporates the improvements of the present invention and is configured for recovery of hydrogen from a fuel gas stream in addition to recovery of LPG utilizing a conventional fractionation tower.

FIG. 4 depicts an alternate embodiment of the present invention wherein the improved hydrogen recovery process is integrated within an LPG recovery process 110 utilizing a conventional fractionation tower. Feed gas stream 12 is first sent through dehydration and inlet processing (not shown). Feed gas stream 12 is then cooled and at least partially condensed by heat exchange contact with one or more process streams in a first exchanger 114 and emerges as a cooled feed gas stream 16. The process streams used to cool feed gas stream 12 can include a first liquid stream 122, a second liquid stream 132, a third liquid stream 144, a third vapor stream 142, a tower vapor stream 164', an external or supplemental refrigerant stream 113, and combinations thereof. In all embodiments of this invention, first exchanger 114 can be a single multi-path exchanger, a plurality of individual heat exchangers, or combinations thereof. The external refrigerant stream 113, such as propylene, can be supplied to first exchanger 114, if needed for additional cooling. Cooled feed gas stream 16 then goes to one or more high-pressure separator(s) 118 or absorbers where a first vapor stream 120 and first liquid stream 122 are produced as a result of separating cooled feed gas stream 16. First liquid stream 122 is sent to first exchanger 114 and emerges as third feed stream 157. First liquid stream 122 can be level controlled by a first level controller 160 based upon a liquid level in high pressure separator 118 that contains first liquid stream 122.

First vapor stream 120 is cooled in second exchanger 124 by heat exchange contact with one or more process streams and emerges as cooled vapor stream 126. The process streams used to cool first vapor stream 120 can include second liquid stream 132, third liquid stream 144, third vapor stream 142, and combinations thereof. Cooled vapor stream 126 is sent to one or more suction separator(s) 128 or absorbers where a second vapor stream 130 and second liquid stream 132 are produced as a result of separating cooled vapor stream 126. Second vapor stream 130 is sent to an expander 26 to decrease the pressure of second vapor stream 130 and emerge as expanded stream 138. During the expansion, the temperature of second vapor stream 130 is lowered and work is produced. This work is later recovered in booster compressor 34 driven by expander 26 to partially regain pressure, while the low temperature of expanded stream 138 is used to at least partially refrigerate the process. Expander 26 can be any type of device resulting in expansion known by one skilled in the art. If needed, expander 26 can be a series of expanders, or an expander train, 27. Expanded stream 138 is sent to one or more hydrogen separator(s) 140 or absorbers where third vapor stream 142 and third liquid stream 144 are produced as a result of separating expanded stream 138. Third vapor stream 142 can be temperature controlled by temperature control valve 146 to bypass second exchanger 124 and first exchanger 114 when feed gas stream 12 needs to be cooled further. Third vapor stream 142 is sent to second exchanger 124 and front end exchanger 14 to provide cooling to the feed gas stream 12 and emerges as warmed vapor stream 32. Warmed vapor stream 32 is then compressed in a booster-compressor 34 and emerges as the recovered hydrogen product stream 36. Booster-compressor 34 can be any type of device resulting in compression known by one skilled in the art. Recovered hydrogen product stream 36 can then be supplied, preferably to a refinery, for further processing.

Third liquid stream 144 is heated in second exchanger 124 and first exchanger 114, wherein at least a portion of third liquid stream 144 is vaporized, producing a first feed stream 154'. Third liquid stream 144 can be level controlled by third level controller 145 based upon the liquid level in hydrogen separator 140. First feed stream 154' is sent to a fractionation tower 156'. Fractionation tower 156' can be any type of device that transfers materials from a liquid phase into a vapor phase and will be known to those skilled in the art. An example of such a tower is a deethanizer tower.

Second liquid stream 132 is heated in second exchanger 124 and first exchanger 114, wherein at least a portion of second liquid stream 132 is vaporized, producing a second feed stream 158. Second liquid stream 132 can be level controlled by second level controller 159 based upon the liquid level in suction separator 128. First liquid stream 122 is heated in first exchanger 114, wherein at least a portion of first liquid stream 122 is vaporized and emerges as third feed stream 157. First liquid stream 122 can be level controlled by first level controller 160, which is based upon the liquid level in high-pressure separator 118, as previously discussed.

In fractionation tower 156', first feed stream 154' and second feed stream 158 are supplied to one or more mid-tower feed trays to produce a tower bottoms stream 160 and tower vapor stream 164'. Second feed stream 158 is typically fed at a lower feed tray than first feed stream 154'. Third feed stream 157 is typically fed at a lower feed tray than second feed stream 158. First, second, and third feed streams 154', 158, 157 can be sent to fractionation tower 156' separately. Alternatively, one or more of the first, second, and third feed streams 154', 158, 157 can be combined and sent to fractionation tower 156' together.

Fractionation tower 156' separates first, second, and third feed streams 154', 158, 157 to produce a fractionation tower bottoms stream 160 and a tower overhead stream 188. Fractionation tower bottoms stream 160 exits fractionation tower 156' preferably through the bottom of fractionation tower 156'. Bottoms stream 160 is cooled in bottoms exchanger 172 to produce an LPG product stream that contains substantially at least 90% of propane ($C_3$) and heavier compounds. Bottoms stream 160 can be level controlled by fourth level controller 173 based upon a liquid level in fractionation tower 156'.

Tower overhead stream 188 is preferably at least partially condensed in an overhead condenser 180 and emerges as a condensed tower stream 191. Condensed tower stream 191 is separated in a condenser separator 184 to produce a tower reflux stream 187 and a tower vapor stream 184. Tower reflux stream 187 is returned or refluxed back to fractionation tower 156'.

Tower vapor stream 164' is warmed in first exchanger 114 by heat exchange contact with one or more process streams. The process streams used to warm tower vapor stream 164' can include third vapor stream 142, feed gas stream 12, first liquid stream 122, second liquid stream 132, third liquid stream 144, and combinations thereof. Tower vapor stream 164' emerges as a fuel gas vapor stream 174. Tower vapor stream 164' can be temperature controlled by temperature control valve 175 based upon a tower overhead temperature. Fuel gas vapor stream 174 is sent to a compressor 42 and compressor cooler 44 in order for fuel gas vapor stream 174 to meet fuel gas specifications. Fuel gas vapor stream 174 contains a fuel gas stream substantially free of hydrogen, which is sent, preferably to a refinery, for further processing.

In addition to the processes for recovery of hydrogen, the apparatuses required to perform the processes are also advantageously provided. Apparatus embodiments are advantageously provided for the recovery of hydrogen and also for the recovery of hydrogen along with the recovery of LPG.

In an embodiment of the present invention, an apparatus for recovering hydrogen from a fuel gas stream by means of a cryogenic process is advantageously provided. The apparatus preferably includes a first cooler 14, a cold separator 18, an expander 26, a first heater 14, a first compressor 34, a second heater 14, a second compressor 42, and a second cooler 44. First cooler 14 is used for cooling and at least partially condensing a feed gas stream 12. Cold separator 18 is used for separating feed gas stream 12 into a first vapor stream 20 and a first liquid stream 22. Expander 26 is preferably used for expanding and thereby decreasing a pressure of first vapor stream 20 to produce an expanded stream 28. First heater 14 preferably heats expanded stream 28 thereby producing warmed vapor stream 32. First compressor 34 compresses warmed vapor stream 32 to produce a product hydrogen stream 36. Second heater 14 preferably heats first liquid stream 22 and at least partially vaporizes first liquid stream 22 to produce a second vapor stream 38. Second compressor 42 is used for compressing second vapor stream 38. Second cooler 44 preferably cools second vapor stream 38 to produce a fuel gas stream substantially free of hydrogen.

First cooler 14, first heater 14, and second heater 14 can be combined into a single first heat exchanger, or front-end exchanger, 14 as shown in FIG. 1, for performing various heat exchanger tasks. The heat exchanger tasks can include cooling and at least partially condensing feed gas stream 12, heating expanded stream 28, heating first liquid stream 22, and combinations thereof. Alternatively, one or more heat exchangers can be used for performing each of the listed tasks. The apparatus can also include a second heat exchanger 21 for cooling and at least partially condensing first vapor stream 20 and a second separator 15 for separating first vapor stream 20 into a second vapor stream 17 and a second liquid stream 19, as illustrated in FIG. 2. If second heat exchanger 21 and second separator 15 are provided, expander 26 will preferably expand second vapor stream 17 and first heat exchanger, or front-end exchanger, 14 will preferably heat and at least partially vaporize second liquid stream 19.

As an alternate embodiment, an apparatus as shown in FIG. 3 for recovering hydrogen and liquefied petroleum gases (LPG) from a fuel gas stream by means of a cryogenic process is advantageously provided. The apparatus in this alternate embodiment preferably includes a first heat exchanger 114, a first separator 118, a second heat exchanger 124, a second separator 128, an expander 26, a third separator 140, a first compressor 34, a reboiled absorber 156, a first cooler 172, a second compressor 42, and a second cooler 44.

First heat exchanger 114 is used for performing various heat exchange tasks. The heat exchanger tasks can include cooling and at least partially condensing a feed gas stream 12, heating and at least partially vaporizing a first liquid stream 122 to produce a third tower feed stream 157, heating and at least partially vaporizing a second liquid stream 132 to produce a second tower feed stream 158, heating and at least partially vaporizing a third vapor stream 142, heating and at least partially vaporizing a third liquid stream 144 to produce a first tower feed stream 154, heating and at least partially vaporizing a tower vapor stream 164, and combinations thereof. First separator 118 is preferably used for separating feed gas stream 12 into first vapor stream 120 and first liquid stream 122. Second heat exchanger 124 is preferably used for performing various heat exchange tasks. The various heat exchanger tasks can include cooling and at least partially condensing first vapor stream 120 to produce a cooled stream 126, heating and at least partially vaporizing third vapor stream 142, heating and at least partially vaporizing first liquid stream 122, heating and at least partially vaporizing second liquid stream 132, heating and at least partially vaporizing third liquid stream 144, and combinations thereof. Second separator 128 separates cooled stream 126 into second vapor stream 130 and second liquid stream 132. Expander 26 expands and thereby decreases a pressure of second vapor stream 130 to produce an expanded stream 138. Third separator 140 preferably separates expanded stream 138 into third vapor stream 142 and third liquid stream 144. First compressor 34 preferably compresses third vapor stream 142 to produce a hydrogen product stream 36 that can be sent for further processing. Reboiled absorber 156 receives and separates first tower feed stream 154 fed at a first theoretical stage of reboiled absorber 156, a second tower feed stream 158, and a third tower feed stream 157 and produces a tower bottoms stream 160 and tower vapor stream 164. First cooler 172 cools tower bottoms stream 160 and produces an LPG product stream 173 that contains substantially at least 70% of propane (C3) and heavier compounds. Second compressor 42 is preferably used for compressing a fuel gas vapor stream 174 that is substantially free of hydrogen, which is sent for further processing. Fuel gas vapor stream 174 is produced by warming tower vapor stream 164. Second cooler 44 is used for cooling fuel gas vapor stream 174. First heat exchanger 114 and second heat exchanger 124 can include separate heat exchangers for performing each of the heat exchange tasks.

Another embodiment of the present invention is also provided, as illustrated in FIG. 4. In this embodiment, another apparatus for recovering hydrogen and liquefied petroleum gases (LPG) from a fuel gas stream by means of a cryogenic process is advantageously provided. The apparatus preferably includes a first heat exchanger 114, a first separator 118, a second heat exchanger 124, a second separator 128, an expander 26, a third separator 140, a first compressor 34, a fractionation tower 156', a first cooler 172, a second cooler 184, a fourth separator 184, a second compressor 42, and a third cooler 44.

First heat exchanger 114 is used to perform various heat exchanger tasks. The heat exchanger tasks can include cooling and at least partially condensing a feed gas stream 12, heating and at least partially vaporizing a first liquid stream 122 to produce a third tower feed stream 157, heating and at least partially vaporizing a second liquid stream 132 to produce a second tower feed stream 158, heating and at least partially vaporizing a third vapor stream 142, heating and at least partially vaporizing a third liquid stream 144 to produce a first tower feed stream 154, heating and at least partially vaporizing a tower vapor stream 164', and combinations thereof. First separator 118 is preferably used for separating feed gas stream 12 into a first vapor stream 120 and a first liquid stream 122. Second heat exchanger 124 is also used for performing various heat exchanger tasks. The various heat exchanger tasks performed by second heat exchanger 124 can include cooling and at least partially condensing first vapor stream 120, heating and at least partially vaporizing third vapor stream 142 to produce a warmed vapor stream 32, heating and at least partially vaporizing first liquid stream 122, heating and at least partially vaporizing second liquid stream 132, heating and at least partially vaporizing third liquid stream 144, and combinations thereof. Second separator 128 separates the cooled stream into a second vapor stream 130 and a second liquid stream 132. Expander 26 preferably expands and decreases a pressure of second vapor stream 130 to produce an expanded stream 138. Third separator 140 preferably separates expanded stream 138 into a third vapor stream 142 and a third liquid stream 144. First compressor 34 preferably compresses the warmed vapor stream 32 to produce a hydrogen product stream 36 that can be sent for further processing. Fractionation tower 156' preferably receives and separates first feed stream 154', second feed stream 158, and third feed stream 157 to produce a fractionation tower bottoms stream 160 and a fractionation tower overhead stream 188. First cooler 172 cools fractionation tower bottoms stream 160 thereby producing an LPG product stream that contains substantially at least 90% of propane (C3) and heavier compounds. Second cooler 180 preferably cools and at least partially condenses fractionation tower overhead stream 188 thereby producing a partially condensed fractionation tower stream 191. Fourth separator 184 separates condensed fractionation tower stream 191 into a fractionation tower reflux stream 187 that is sent back to fractionation tower 156' and a fractionation tower vapor stream 164'. Second compressor 42 preferably compresses fuel gas vapor stream 174 that contains a fuel gas stream substantially free of hydrogen, which is sent for further processing. Fuel gas vapor stream 174 is produced by warming fractionation tower vapor stream 164'. First heat exchanger 114 and second heat exchanger 124 can include separate heat exchangers for performing each of the heat exchange tasks.

As an advantage of this invention, the new process can be used to recover hydrogen from fuel gas streams with only a minimal decrease in hydrogen purity. The hydrogen yield is typically around 99.5%, while the purity is around 95%, as compared to the hydrogen purity of prior art methods, which is around 99.99% purity. Another advantage of the new process is that the hydrogen recovery process can be integrated into other processes that recover other components from fuel gas streams. As shown in FIG. 2, the process can be integrated within a LPG recovery process to increase the amount of hydrogen that is recovered simultaneously with the LPG from the fuel gas stream. The process can be used in new plants or to modify existing plants. Other advantages are that the process is simple and has a simple equipment setup, which reduces initial capital costs and operating costs for the unit.

While the invention has been shown or described in only some of its forms, it should be apparent to those skilled in the art that it is not so limited, but is susceptible to various changes without departing from the scope of the invention.

For example, various means of heat exchange can be used to supply the reboiler with heat. The reboiler can be more than one exchanger or be a single multi-pass exchanger. Equivalent types of reboilers will be known to those skilled in the art. As another example, it is envisioned that the process could be packaged in small modules for the convenience of transportation and installation since the process is simple and does not require much process equipment. This is particularly apparent for the embodiments of the invention that is illustrated in FIGS. 1 and 2 of the drawings. As another example, the level controllers can be level control valves or any other type of flow meter or controller capable of controlling an amount of liquid that is allowed to exit the bottom of a vessel. Suitable controllers will be known to those skilled in the art and are to be considered within the scope of the present invention.

We claim:

1. A process for recovering hydrogen from a fuel gas stream by means of a stand-alone cryogenic process comprising the steps of:

supplying and cooling and at least partially condensing a feed gas stream;

separating the feed gas stream into a first vapor stream and a first liquid stream;

expanding and thereby decreasing a pressure of the first vapor stream to produce an expanded stream;

heating the expanded stream thereby producing a warmed vapor stream;

compressing the warmed vapor stream to produce a product hydrogen stream;

heating the first liquid stream and at least partially vaporizing the first liquid stream to produce a second vapor stream; and compressing and cooling the second vapor stream to produce a fuel gas stream substantially free of hydrogen, whereby the cryogenic process is a stand-alone process.

2. The process according to claim 1, wherein the step of cooling the feed gas stream includes cooling the feed gas stream by heat exchange contact with a process stream selected from the group consisting of the first liquid stream, the product hydrogen stream, an external refrigerant stream, and combinations thereof.

3. A process for recovering hydrogen from a fuel gas stream by means of a stand-alone cryogenic process comprising the steps of:

supplying and cooling and at least partially condensing a feed gas stream;

separating the feed gas stream into a first vapor stream and a first liquid stream;

cooling and at least partially condensing the first vapor stream and separating the first vapor stream into a second vapor stream and a second liquid stream;

expanding and thereby decreasing a pressure of the second vapor stream to produce an expanded stream;

heating the expanded stream thereby producing a warmed vapor stream;

compressing the warmed vapor stream to produce a product hydrogen stream;

heating the first liquid stream and the second liquid stream and at least partially vaporizing the first liquid stream and the second liquid stream to produce a third vapor stream; and compressing and cooling the third vapor stream to produce a fuel gas stream substantially free of hydrogen, whereby the cryogenic process is a stand-alone process.

4. The process according to claim 3, wherein the step of cooling the feed gas stream includes cooling the feed gas stream by heat exchange contact with a process stream selected from the group consisting of the first liquid stream, the product hydrogen stream, an external refrigerant stream, and combinations thereof.

5. The process according to claim 3, wherein the step of cooling the first vapor stream includes cooling the feed gas stream by heat exchange contact with a process stream selected from the group consisting of the second liquid stream, the product hydrogen stream, an external refrigerant stream, and combinations thereof.

6. A process for recovering hydrogen and liquefied petroleum gases (LPG) from a fuel gas stream by means of a cryogenic process comprising the steps of:

supplying and cooling and at least partially condensing a feed gas stream;

separating the feed gas stream into a first vapor stream and a first liquid stream;

cooling and at least partially condensing the first vapor stream to produce a cooled stream;

separating the cooled stream into a second vapor stream and a second liquid stream;

expanding and thereby decreasing a pressure of the second vapor stream to produce an expanded stream;

separating the expanded stream into a third vapor stream and a third liquid stream;

warming the third vapor stream thereby producing a warmed vapor stream and compressing and cooling the warmed vapor stream to produce a hydrogen product stream that can be sent for further processing;

heating the third liquid stream thereby vaporizing at least a portion of the third liquid stream thereby producing a first tower feed stream and supplying the first tower feed stream to a first stage of a reboiled absorber;

heating the second liquid stream and vaporizing at least a portion of the second liquid stream thereby producing a second tower feed stream and supplying the second tower feed stream to the reboiled absorber;

heating the first liquid stream and vaporizing at least a portion of the first liquid stream thereby producing a third tower feed stream and supplying the third tower feed stream to the reboiled absorber;

separating the first, second, and third feed streams to produce a tower bottoms stream and a tower overhead stream;

cooling the tower bottoms stream thereby producing an LPG product stream that contains substantially at least 70% of propane (C3) and heavier compounds; and heating and compressing and then cooling the tower vapor stream that contains a fuel gas stream substantially free of hydrogen, which is sent for further processing.

7. The process of claim 6, wherein the step of cooling the feed gas stream includes heat exchanging the feed gas stream with a process stream selected from the group consisting of the first liquid stream, the second liquid stream, the third liquid stream, the third vapor stream, the tower overhead stream, an external refrigerant stream, and combinations thereof.

8. A process according to claim 6, wherein the step of cooling the first vapor stream to produce a cooled stream including heat exchanging the first vapor stream with a process stream selected from the group consisting of the second liquid stream, the third liquid stream, the third vapor stream, an external refrigerant stream, and combinations thereof.

9. A process according to claim 6, wherein the second tower feed stream is fed to the reboiled absorber at a lower feed tray than the first tower feed stream.

10. A process according to claim 6, wherein the step of warming the tower overhead stream includes warming the tower overhead stream by heat exchange contact with a stream selected from the group consisting of the third vapor stream, the feed gas stream, the first liquid stream, the second liquid stream, the third liquid stream, an external cooling stream, and combinations thereof.

11. A process according to claim 6, wherein the step of supplying the reboiled absorber with the first, second, and third feed stream includes supplying the reboiled absorber with the first, second, and third feed streams independently.

12. A process according to claim 6, wherein the step of supplying the reboiled absorber with the first, second, and third feed streams includes combining one or more of the first, second, and third feed streams prior to supplying the first, second, and third streams to the reboiled absorber.

13. A process for recovering hydrogen and liquefied petroleum gases (LPG) from a fuel gas stream by means of a cryogenic process comprising the steps of:

supplying and cooling and at least partially condensing a feed gas stream;

separating the feed gas stream into a first vapor stream and a first liquid stream;

cooling and at least partially condensing the first vapor stream to produce a cooled stream;

separating the cooled stream into a second vapor stream and a second liquid stream;

expanding and thereby decreasing a pressure of the second vapor stream to produce an expanded stream;

separating the expanded stream into a third vapor stream and a third liquid stream;

warming the third vapor stream thereby producing a warmed vapor stream and compressing and cooling the warmed vapor stream to produce a hydrogen product stream that can be sent for further processing;

heating the third liquid stream thereby vaporizing at least a portion of the third liquid stream thereby producing a first feed stream and supplying the first feed stream to a fractionation tower;

heating the second liquid stream and vaporizing at least a portion of the second liquid stream thereby producing a second feed stream and supplying the second feed stream to the fractionation tower;

heating the first liquid stream and vaporizing at least a portion of the first liquid stream thereby producing a third feed stream and supplying the third feed stream to the fractionation tower;

separating the first, second, and third feed streams within the fractionation tower to produce a fractionation tower bottoms stream and a fractionation tower overhead stream;

cooling the fractionation tower bottoms stream thereby producing an LPG product stream that contains substantially at least 90% of propane (C3) and heavier compounds;

cooling and at least partially condensing the fractionation tower overhead stream thereby producing a partially condensed fractionation tower stream;

separating the condensed fractionation tower stream into a fractionation tower reflux stream that is sent back to the fractionation tower and a fractionation tower vapor stream; and warming and compressing and then cooling the fractionation tower vapor stream that contains a fuel gas stream substantially free of hydrogen, which is sent for further processing.

14. The process of claim 13, wherein the step of cooling the feed gas stream includes cooling the feed gas stream by heat exchange contact with a process stream selected from the group consisting of the first liquid stream, the second liquid stream, the third liquid stream, the third vapor stream, the tower overhead stream, an external refrigerant stream, and combinations thereof.

15. A process according to claim 13, wherein the step of cooling the first vapor stream to produce a cooled stream includes cooling the first vapor stream by heat exchange contact with a process stream selected from the group consisting of the second liquid stream, the third liquid stream, the third vapor stream, an external refrigerant stream, and combinations thereof.

16. A process according to claim 13, wherein the second feed stream is typically fed to the fractionation tower at a lower feed tray than the first feed stream.

17. A process according to claim 13, wherein the step of warming the fractionation tower vapor stream includes warming the fractionation tower vapor stream by heat exchange contact with a stream selected from the group consisting of the third vapor stream, the feed gas stream, the first liquid stream, the second liquid stream, the third liquid stream, an external cooling stream, and combinations thereof.

18. A process according to claim 13, wherein the step of supplying the fractionation tower with the first, second, and third feed streams includes supplying the fractionation tower with the first, second, and third feed streams independently.

19. A process according to claim 13, wherein the step of supplying the fractionation tower with the first, second, and third feed streams includes combining one or more of the first, second, and third feed streams prior to supplying the first, second, and third streams to the fractionation tower.

20. An apparatus for recovering hydrogen from a fuel gas stream by means of a cryogenic process comprising:

a first cooler for cooling and at least partially condensing a feed gas stream;

a separator for separating the feed gas stream into a first vapor stream and a first liquid stream;

an expander for expanding and thereby decreasing a pressure of the first vapor stream to produce an expanded stream;

a first heater for heating the expanded stream thereby producing a warmed vapor stream;

a first compressor for compressing the warmed vapor stream to produce a product hydrogen stream;

a second heater for heating the first liquid stream and at least partially vaporizing the first liquid stream to produce a second vapor stream; and a second compressor for compressing and a second cooler for cooling the second vapor stream to produce a fuel gas stream substantially free of hydrogen, whereby the cryogenic process is a stand-alone process.

21. The apparatus according to claim 20, wherein the first cooler, first heater, and second heater comprise a single heat exchanger for performing a heat exchanger task selected from the group consisting of cooling the feed gas stream, heating the expanded stream, heating the first liquid stream, and combinations thereof.

22. The apparatus according to claim 20, further including a third cooler for cooling and at least partially condensing the first vapor stream and a second separator for separating the first vapor stream into a second vapor stream and a second liquid stream and wherein the expander expands the second vapor stream and the second heater heats and at least partially vaporizes the second liquid stream.

23. An apparatus for recovering hydrogen and liquefied petroleum gases (LPG) from a fuel gas stream by means of a cryogenic process comprising:

a first heat exchanger for performing heat exchange tasks selected from the group consisting of cooling and at least partially condensing a feed gas stream, heating and at least partially vaporizing a first liquid stream to produce a third tower feed stream, heating and at least partially vaporizing a second liquid stream to produce a second tower feed stream, heating and at least partially vaporizing a third vapor stream, heating and at least partially vaporizing a third liquid stream to produce a first tower feed stream, heating and at least partially vaporizing a tower vapor stream, and combinations thereof;

a first separator for separating the feed gas stream into the first vapor stream and the first liquid stream;

a second heat exchanger for performing heat exchange tasks selected from the group consisting of cooling and at least partially condensing the first vapor stream, heating and at least partially vaporizing the third vapor stream, heating and at least partially vaporizing the first liquid stream, heating and at least partially vaporizing the second liquid stream, heating and at least partially vaporizing the third liquid stream, and combinations thereof;

a second separator for separating the cooled stream into the second vapor stream and the second liquid stream;

an expander for expanding and thereby decreasing a pressure of the second vapor stream to produce an expanded stream;

a third separator for separating the expanded stream into the third vapor stream and the third liquid stream;

a first compressor for compressing the third vapor stream to produce a hydrogen product stream that can be sent for further processing;

a reboiled absorber for receiving and separating the first tower feed stream fed at a first stage of the reboiled absorber, a second tower feed stream, and a third tower feed stream to produce a tower bottoms stream and a tower overhead stream;

a first cooler for cooling the tower bottoms stream thereby producing an LPG product stream that contains substantially at least 70% of propane (C3) and heavier compounds;

a second compressor for compressing and a second cooler for cooling the tower vapor stream that contains a fuel gas stream substantially free of hydrogen, which is sent for further processing.

24. The apparatus according to claim 23, wherein the first heat exchanger and the second heat exchanger comprise a separate heat exchanger for performing each of the heat exchange tasks.

25. An apparatus for recovering hydrogen and liquefied petroleum gases (LPG) from a fuel gas stream by means of a cryogenic process comprising the steps of:

a first heat exchanger for performing heat exchange tasks selected from the group consisting of cooling and at least partially condensing a feed gas stream, heating and at least partially vaporizing a first liquid stream to produce a third tower feed stream, heating and at least partially vaporizing a second liquid stream to produce a second tower feed stream, heating and at least partially vaporizing a third vapor stream, heating and at least partially vaporizing a third liquid stream to produce a first tower feed stream, heating and at least partially vaporizing a tower vapor stream, and combinations thereof;

a first separator for separating the feed gas stream into a first vapor stream and a first liquid stream;

a second heat exchanger for performing heat exchange tasks selected from the group consisting of cooling and at least partially condensing the first vapor stream, heating and at least partially vaporizing the third vapor stream, heating and at least partially vaporizing the first liquid stream, heating and at least partially vaporizing the second liquid stream, heating and at least partially vaporizing the third liquid stream, and combinations thereof;

a second separator for separating the cooled stream into a second vapor stream and a second liquid stream;

an expander for expanding and thereby decreasing a pressure of the second vapor stream to produce an expanded stream;

a third separator for separating the expanded stream into a third vapor stream and a third liquid stream;

a first compressor for compressing the warmed vapor stream to produce a hydrogen product stream that can be sent for further processing;

a fractionation tower for receiving and separating the first feed stream, the second feed stream, and the third feed stream to produce a fractionation tower bottoms stream and a fractionation tower overhead stream;

a first cooler for cooling the fractionation tower bottoms stream thereby producing an LPG product stream that contains substantially at least 90% of propane (C3) and heavier compounds;

a second cooler for cooling and at least partially condensing the fractionation tower overhead stream thereby producing a partially condensed fractionation tower stream;

a fourth separator for separating the condensed fractionation tower stream into a fractionation tower reflux stream that is sent back to the fractionation tower and a fractionation tower vapor stream; and a second compressor for compressing the fractionation tower vapor stream that contains a fuel gas stream substantially free of hydrogen, which is sent for further processing.

26. The apparatus according to claim 25, wherein the first heat exchanger and the second heat exchanger comprise a separate heat exchanger for performing each of the heat exchange tasks.

* * * * *